US010086421B2

(12) United States Patent
Graff

(10) Patent No.: US 10,086,421 B2
(45) Date of Patent: Oct. 2, 2018

(54) TOOL FOR HOT FORMING A WORKPIECE AND METHODS FOR SELECTIVELY HOT FORMING CERTAIN REGIONS OF A WORKPIECE

(71) Applicants: THYSSENKRUPP STEEL EUROPE AG, Duisburg (DE); THYSSENKRUPP AG, Essen (DE)

(72) Inventor: Stéphane Graff, Unna (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 14/989,395

(22) Filed: Jan. 6, 2016

(65) Prior Publication Data

US 2016/0193646 A1 Jul. 7, 2016

(30) Foreign Application Priority Data

Jan. 7, 2015 (DE) ..... 10 2015 100 100

(51) Int. Cl.

| | |
|---|---|
| ***B21D 22/02*** | (2006.01) |
| ***B21D 37/16*** | (2006.01) |
| ***C21D 1/673*** | (2006.01) |
| *C21D 9/00* | (2006.01) |

(52) U.S. Cl.

CPC ..... *B21D 22/022* (2013.01); *B21D 37/16* (2013.01); *C21D 1/673* (2013.01); *C21D 9/00* (2013.01); *C21D 2221/00* (2013.01)

(58) Field of Classification Search

CPC ..... B21D 22/022; B21D 37/16; B21D 24/16; B21D 22/208

See application file for complete search history.

(56) References Cited

U.S. PATENT DOCUMENTS 3,015,292 A * 1/1962 Bridwell ..... B21D 37/16 100/320
8,069,697 B2 * 12/2011 Kurisu ..... B21D 22/022 72/342.3
2010/0300584 A1 12/2010 Buschsieweke et al.

(Continued)

FOREIGN PATENT DOCUMENTS

CN 101796202 A 8/2010
CN 104043732 A 9/2014

(Continued)

OTHER PUBLICATIONS

English language Abstract for DE 10 2005 032 113 B3.

(Continued)

*Primary Examiner* — Teresa M Ekiert
(74) *Attorney, Agent, or Firm* — Lathrop Gage L.L.P.

(57) ABSTRACT

A tool for machining a workpiece may comprise multiple parts that have different temperatures when the tool is being operated. To reduce or, in some cases, eliminate thermal radiation between the multiple parts, the tool may incorporate one or more devices that manipulate the thermal radiation. Such devices may be disposed along one or more of the multiple parts and, in some examples, between two or more parts of the tool. These devices may also help reduce and, at times, eliminate thermal radiation between the tool parts and the surrounding environment.

20 Claims, 2 Drawing Sheets

(56) References Cited

U.S. PATENT DOCUMENTS

| | | | | |
|---|---|---|---|---|
| 2011/0030442 | A1 | 2/2011 | Lety et al. | |
| 2012/0186705 | A1* | 7/2012 | Sikora | B21D 37/16 148/516 |
| 2014/0124104 | A1 | 5/2014 | Trippe et al. | |
| 2014/0124105 | A1* | 5/2014 | Trippe | B21D 22/022 148/567 |
| 2014/0260493 | A1 | 9/2014 | Yoon | |
| 2014/0326035 | A1* | 11/2014 | Halford | B29C 33/046 72/342.4 |
| 2014/0345757 | A1 | 11/2014 | Hartmann et al. | |
| 2017/0144207 | A1 | 5/2017 | Trippe et al. | |

FOREIGN PATENT DOCUMENTS

| | | | |
|---|---|---|---|
| DE | 10162438 | A1 | 7/2003 |
| DE | 102004026762 | A1 | 2/2006 |
| DE | 102005032113 | B3 | 2/2007 |
| DE | 102011056444 | A1 | 1/2013 |
| DE | 102012110649 | B3 | 11/2013 |
| KR | 20100063514 | A | 6/2010 |

OTHER PUBLICATIONS

English language Abstract for DE 10162438 A1.
English language Abstract for DE 102004026762 A1.
English language Abstract for KR 20100063514 A.

* cited by examiner

TOOL FOR HOT FORMING A WORKPIECE AND METHODS FOR SELECTIVELY HOT FORMING CERTAIN REGIONS OF A WORKPIECE

CROSS REFERENCE TO RELATED APPLICATIONS

This application claims priority to prior filed German Patent Application No. DE 102015100100.4 filed Jan. 7, 2015, the entire contents of which are hereby incorporated by reference herein.

FIELD

The present disclosure relates to tools and methods for selectively hardening certain regions of a workpiece.

BACKGROUND

Tools for converting sheets into desired shapes by means of hot forming are known. For instance, the sheets are placed into the tool and acquire their final shape through hot forming. To this end, regions of the tool are typically heated to high temperatures (several hundred degrees). At such temperatures, a considerable amount of heat is transmitted to the environment and thus lost. Means for heating portions of the tool, for instance, heating cartridges, must therefore constantly offset this loss by re-heating, which reduces energy efficiency throughout the sheet forming process. Moreover, parts of tools that operate more optimally at or require a lower temperature are inadvertently heated.

In order to reduce heat transfer between hot parts of tools and the environment or a machine, as well as between parts of tools that have different temperatures, the prior art, such as in US Patent Publication No. 2011/0030442A1, for instance, discloses inserting a gap between tool parts with different temperatures to reduce direct heat transfer between the tool parts during hot forming of the workpiece.

DETAILED DESCRIPTION

Figure 1:
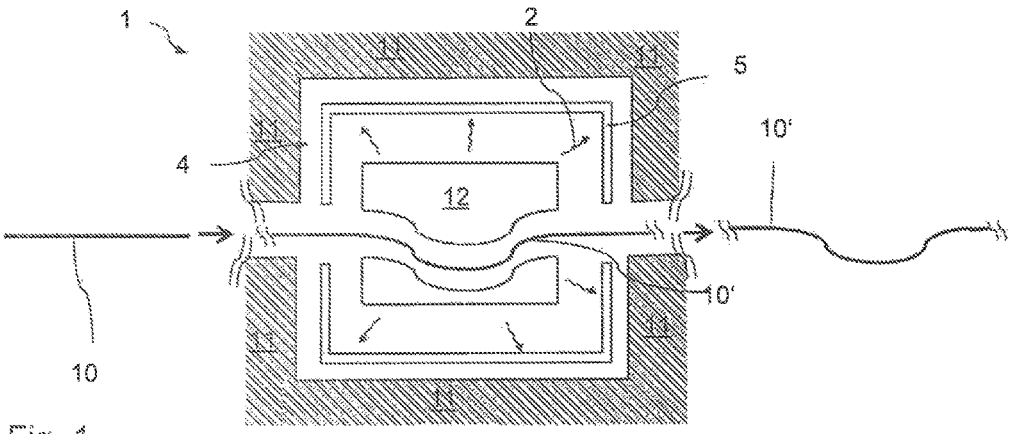
FIG. 1 is a diagrammatic view of an example tool for selectively hardening certain regions of a workpiece.

As those having ordinary skill in the art will appreciate, although certain example apparatus and methods are disclosed herein, the scope of coverage of this patent is not limited thereto. On the contrary, this patent covers all methods, apparatus, and articles of manufacture fairly falling within the scope of the appended claims either literally or under the doctrine of equivalents.

One example object of the present disclosure is to provide a tool in which the heat transfer between tool and environment or between individual tool parts that are heated to different temperatures for hardening is further improved in relation to the prior art. Likewise, the present disclosure enables more energy-efficient use of tools such as, for instance, in the hot forming of sheets.

Various objects of the present disclosure are achieved by a tool for the hot forming of a workpiece. In some examples, the tool comprises a first tool part and/or a second tool part, wherein, for heating of the workpiece, the first tool part for heating of the workpiece assumes a different temperature from the second tool part or from an environment of the tool, wherein the tool has a device for manipulating the thermal radiation. As those having ordinary skill in the art will understand, "first tool part" and "second tool part" may be shortened, respectively, to "first part" and "second part."

The tool provides a device for manipulating thermal radiation, with which the loss of heat, induced by thermal radiation, between the first tool part and the environment, or the transfer of heat from the first to the second tool part, can be advantageously reduced in relation to the prior art. In this way, the maintenance of an existing temperature difference between the tool parts and of the temperature control of the entire tool can be supported, so that a particularly energy-efficient use of the tool is ultimately enabled. Through the reduction of heat transfer, a temperature profile along the first or second tool part can also be advantageously improved in terms of spatial homogeneity. In addition, in the tool can be obtained spatially clearly discernible temperature zones, which, in the course of the hardening, advantageously lead to narrow transition regions between workpiece regions of different hardness.

The tool may be designed for hot forming or for "tailored tempering." In particular, with the first and the second tool part, the pre-heated workpiece is maintained during the forming at a certain temperature on a regionally selective basis, or is cooled only down to tool temperature and is subsequently kept at the appropriate temperature. For instance, the workpiece is a sheet that is heated to a temperature within the range from 720° C. to 900° C., is subsequently arranged in the tool, and acquires its final shape through the forming effected by the tool. In this case, by virtue of the tool parts at different temperatures, and the therewith associated different cooling rates or dwell times, purposefully different material properties are obtained in the regions of the workpiece. In addition, the tool may have a die-like tool effective area, against which in the operating state the workpiece bears and by the action of which the workpiece is then worked. Further, the shape of the tool effective area may be tailored to the subsequent shape of the formed workpiece. In particular, the tool may be designed at least partially as a press. In this example, the device for manipulating the thermal radiation is, at least in some regions, part of the first and/or second tool part, or can be disposed between the first and the second tool part. In particular, the device may be a feature of the first and/or second component.

In some examples, a surface character of the first tool part, in particular of the tool effective area, and/or of the second tool part for manipulating the thermal radiation, may be modified. In such examples, by virtue of the surface character, the device for manipulating the thermal radiation is formed. In particular, the first and/or the second tool part, following a treatment, in particular an after-treatment, such as, for example, polishing, coating or roughening, may have at least in some places an altered surface character. In particular, the surface characters of the tool parts at different temperatures, e.g., of the first and the second tool part, can mutually differ. Through the modification of the surface character, the quantity of thermal radiation exchanged between the tool parts at different temperatures, as well as delivered to the environment, can be advantageously controlled or manipulated.

In other examples, the first tool part and the second tool part may be at least partially spatially separated from each other by a gap. By virtue of the gap, a direct heat transfer from the second tool part to the first tool part is advantageously reduced. In particular, the device for manipulating the thermal radiation may be disposed within the gap. The device may then be introduced into and/or arranged exchangeably in the gap for the manipulation of the thermal radiation, whereby the device for manipulating the thermal radiation can be adapted as optimally as possible to the prevailing circumstances. In a further example, a device of this type can likewise be disposed between tool parts and the environment.

In some examples, the tool for manipulating the thermal radiation has a coating. The coating in this example forms the device for manipulating the thermal radiation. Such a coating can be advantageously applied comparatively easily to the first and/or the second tool part and takes up little space. The coating may be designed such that the coating absorbs or reflects the thermal radiation. In particular, the coating may be tailored to a spectral distribution of the thermal radiation, wherein the coating absorbs or reflects over a wide band within the infrared spectral range. By adapting the coating to the spectral distribution of the thermal radiation, it is possible to manipulate the thermal radiation particularly effectively. In addition, the coating is chosen such that it at least partially co-determines an emission of the thermal radiation. In particular, the first or the second tool part is coated with a material having a specific emission coefficient in order to manipulate the emission radiating from the first or second tool part. In this example, the coating may be comprise a lacquer and/or a structured primer. In particular, the coating can advantageously have the effect that the thermal radiation between the tool parts at different temperatures is manipulated, in particular reduced.

In some examples, the first tool part has a coating which varies from the coating of the second tool part. In particular, the second tool part has a higher temperature than the first tool part and, as a result of the coating, the second tool part assumes or has at least in part a darker colour than the first tool part, in particular is coloured black. The second tool part thereby becomes, for instance, a type of black body, and as much radiation as possible is absorbed by the coating of the first tool part. Moreover, if the first tool part has a lower temperature than the second tool part, the first tool part may assume or have at least in part a lighter colour than the second tool part, by virtue of the coating, for example. The first tool part thereby becomes, for instance, a type of white body, which reflects as much radiation as possible.

In some examples, a secondary surface of the second tool part may have a greater roughness compared to a primary surface of the first tool part. As a result of the increased roughness of the secondary surface, its ability to absorb thermal radiation is advantageously further enhanced. The primary surface, on the other hand, may be polished and may reflect the thermal radiation in the direction of the first tool part.

In some examples, the secondary surface may lie opposite the primary surface. In particular, the secondary surface and the primary surface lie at least partially opposite each other along the gap. The secondary surface and the primary surface may be of complementary configuration. In particular, the secondary surface may be rougher and, in terms of colouring, darker than the primary surface. This can advantageously have the effect of reducing the heat transfer from the second tool part to the first tool part.

In some examples, a device is arranged between the first tool part and the second tool part that reflects thermal radiation. In particular, the device reflecting the thermal radiation, such as a mirror, for example, may be disposed within the gap. The reflective properties of the device may be tuned to the anticipated, spectral distribution of the thermal radiation. The device reflecting the thermal radiation may reflect over a wide band within the infrared spectral range. In addition, the device reflecting the thermal radiation may be arranged exchangeably in the gap. As a result, a device, tuned to the desired operating temperature, for manipulating the thermal radiation can be inserted into the gap.

According to some examples, a reflective side of the device reflecting the thermal radiation may be directed towards the second tool part. Further, the device reflecting the thermal radiation may have on its rear side an absorbent part, which absorbs the thermal radiation emanating from the first tool part. Through the alignment of the device reflecting the thermal radiation, a heat transfer between the tool parts at different temperatures is advantageously reduced.

A further subject of the present disclosure is a method for the regionally selective hot forming of a workpiece with a tool, wherein in a method step a the heated workpiece is disposed in the tool, wherein in a method step b the workpiece is worked, and/or at least in some regions maintained at a certain temperature or cooled at different speeds, with the first tool part and/or the second tool part, and wherein in a method step c the workpiece is removed and, if need be, after-treated for further microstructure adjustment. The workpiece may be cooled at different speeds via tool parts at different temperatures, for instance the first and second tool part, or may be maintained at a certain temperature, whereby material properties, such as hardness or ductility, on the shaped and ultimately hardened workpiece can be purposefully co-determined.

With reference now to the figures, like parts are provided with like reference symbols and are therefore also generally respectively named or mentioned only once. In the figures, the curved lines are used to indicate that only a detail from the respective tool is viewed. Furthermore, the representations are heavily simplified for better comprehension and are not necessarily to scale or proportion. As merely an example, in many cases a second tool part 12 does not encompass a first tool part 11.

FIG. 1 depicts an example tool 1. In this example, the tool 1 serves to hot-form a workpiece 10, such as a steel sheet, for example and without limitation. That is to say, the tool 1 maintains the heated workpiece 10 at or above a certain temperature and works the workpiece 10 into a shaped workpiece 10'. In this example, the tool 1 may at least partially have a die-like configuration. To this end, the tool 1 may comprise a shaping tool effective area, which in an operating state enters into operative connection with the workpiece 10 such that the workpiece 10 is at least partially worked and, in particular, assumes a shape predefined by the tool effective area. The tool effective area in this example forms one side of the tool 1, against which the workpiece 10 bears.

The deformation may be performed, e.g., pressed, at a pressure that acts on the workpiece 10. The heated workpiece 10, in a method step a, may be placed into the tool 1. In a method step b, the workpiece 10 may be worked and in some regions may be maintained at a certain temperature or cooled at different speeds. To this end, the tool may have a first tool part 11 and a second tool part 12, with which different regions of the workpiece 1 may be brought to different temperatures, in some cases within the range from 450° C. to 550° C., after which, in a method step c, the workpiece 10 may in some cases be removed from the tool 1 and cooled external to the tool 1. The workpiece 10 in this example may be cooled by the air surrounding the tool 1.

With continued reference to FIG. 1, a part of the tool 1 and a part of the workpiece 10 are shown. The part of the tool is represented in which the first tool part 11 and the second tool part 12 are disposed adjacent to each other. For instance, the second tool part 12 comprises at least partially a tool effective area with which the workpiece 10 is worked. In particular, the first and the second tool part 11 and 12 comprise tool effective areas with which the workpiece 10 can be worked. As a result, tool regions which have been heated to different temperatures can respectively be worked with the appropriate tool parts. In order to avoid heat losses, the tool 1 may comprise a device for manipulating the thermal radiation 2.

In particular, in the example shown in FIG. 1, it is provided to prevent, with the device for manipulating the thermal radiation 2, the transfer of heat in the form of thermal radiation 2 from the second tool part 12 to the first tool part 11, wherein the second tool part 12 for controlling the temperature of the workpiece is warmer than the first tool part 11, e.g., possesses a higher intrinsic temperature than the first tool part 11. In this example, the second tool part 12 and the first tool part 11 are mutually separated by a gap 4, and in the gap 4 is arranged a device 5 which reflects the thermal radiation 2, such as a mirror for the reflection of infrared light, for example. In another example, the tool comprises the device for manipulating the thermal radiation in order to prevent the heat loss to the environment. The device 5 reflecting the thermal radiation 2 may comprise a side that is highly reflective for the thermal radiation 2 radiating from the second tool part 12. This highly reflective side may in some examples be directed towards the second tool part 12, so that the thermal radiation 2 is reflected back onto the second tool part 12. The highly reflective side may comprise a material and/or a coating 3 for the reflection of infrared light. In addition, the highly reflective side may be tailored to an operating temperature assumed by the second tool part 12 in the operating state, and the therewith associated spectral distribution of the thermal radiation 2, in that, for instance, a wavelength for which the highly reflective side provides maximum reflection falls into a wavelength range in which the workpiece 10, at operating temperature, most emits thermal radiation 2.

By virtue of the highly reflective side, a heat loss of the second tool part 12 can be advantageously avoided, which ultimately ensures an efficient operation of the total tool 1. Further, the device 5 reflecting the thermal radiation 2 may have an absorbent side that lies opposite the highly reflective side and is directed towards the first tool part 11. In particular, the absorbent side is tailored to the thermal radiation radiating from the first tool part 11, in particular to the spectral thermal radiation profile thereof. As a result of the manipulation of the thermal radiation 2 between the first and the second tool part 11 and 12, a temperature difference can be advantageously maintained in an energy-efficient manner. Apart from the device for manipulating the thermal radiation 2 between the first and the second tool part 11 and 12, an insulating layer may be installed.

Figure 2:
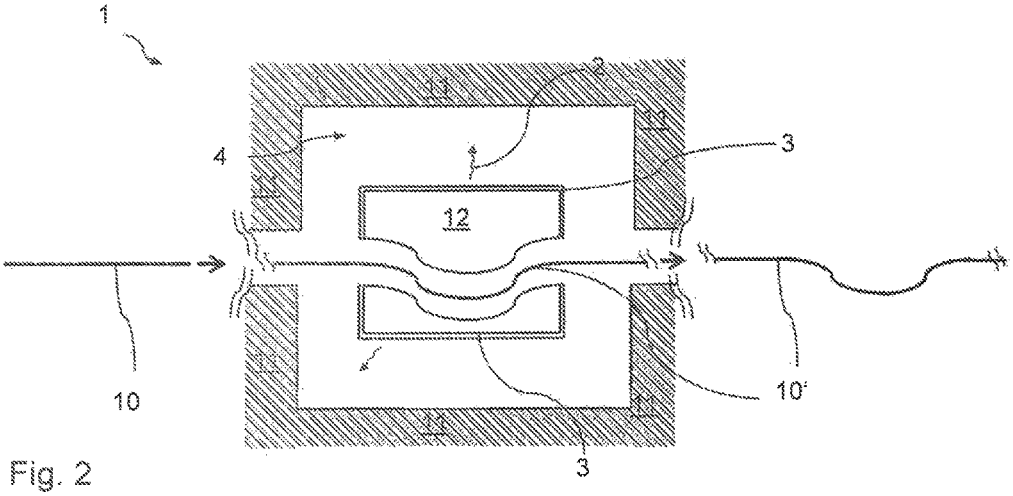
FIG. 2 is a diagrammatic view of an example tool having an example surface character for manipulating thermal radiation.

FIG. 2 shows another example tool 1 according to the present disclosure. The tool 1 shown in FIG. 2 differs from that shown in FIG. 1 by the measure which is adopted to manipulate the thermal radiation 2. Those having ordinary skill in the art will recognize that different measures for manipulating the thermal radiation 2 may be combined. Furthermore, as shown in FIG. 2, a surface character of the tool 1 may be designed to manipulate the thermal radiation 2. In particular, the first tool part 11 may be coated or coloured white. As a white body, thermal radiation can thereby be advantageously reflected, and thus radiation losses avoided. For instance, the second tool part 12 for lowering the thermal radiation emission is at least partially coated with a black coating 3, whereby the second tool part 12 advantageously at least partially assumes the thermal radiation emission characteristics of a black body. The surface of the second tool part 12 may be roughened and the thermal radiation 2 that is potentially transferable from the second tool part 12 to the first tool part 11 is thereby reduced. The surface character along a secondary surface may be modified, e.g., roughened or coated, wherein the secondary surface is disposed opposite a primary surface of the first tool part 11 along the gap 4.

In addition, in some instances, the surface character of the first tool part 11 may be at least in part, along the primary surface, complementary to the modified surface character of the second tool part 12. In particular, the surface of the second tool part 12 has along the primary surface a smooth surface, or is coated or lined with a reflective coating 3. The absorbent coating 3 may be at least partially white, whereby the first tool part 11 advantageously assumes the thermal radiation emission characteristics of a white body.

Figure 3:
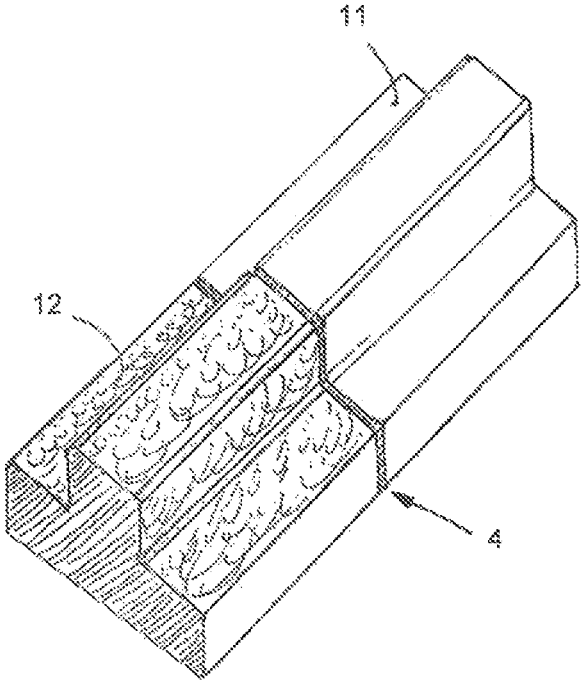
FIG. 3 is a perspective view of an example tool having multiple parts separated by a gap for reducing and/or eliminating heat transfer.

FIG. 3 shows another example tool 1. The tool 1 shown in FIG. 3, in the form of a warm punch, comprises a first tool part 11 and, in the form of a cold punch, comprises a second tool part 12, wherein the first tool part 11 is separated from the second tool part 12 by a gap 4. In this example, the workpiece 1, in the region of the first tool part 11, can be maintained at a certain temperature or only intended to be cooled to a tool temperature. As a result of the different cooling speeds or dwell times, different microstructures are formed in the workpiece, whereby the material properties can be adjusted. In this example, the tool may interact with a die-like, companion part of the tool 1, wherein the first tool part 11 comprises an effective area. Via this effective area, heat energy is lost whenever the tool 1, for instance for the reception of the workpiece 10, is opened, e.g., the companion part is distanced from the effective area. Therefore, the thermal radiation 2 to the environment is lessened, wherein principally that heat loss is lessened which occurs via the effective area to the environment, in particular when the tool 1 is open. Likewise, the thermal radiation between the first tool part 11 and the second tool part 12 is lessened, wherein the temperature exchange between the first tool part 11 and the second tool part 12 is reduced.

What is claimed is:

1. A tool for hot forming a workpiece, the tool comprising:

a first part having a first temperature and being configured to hold a temperature of a heated workpiece, or to cool a temperature of the heated workpiece to a temperature of the tool;

a second part having a second temperature that is warmer than the first temperature of the first part; and a device for manipulating thermal radiation, wherein said device for manipulating thermal radiation comprises a coating disposed on the first part, and wherein the coating disposed on the first part is white for reflecting thermal radiation from the second part.

2. The tool of claim 1, wherein the second part comprises a secondary surface that has a greater roughness in comparison with a primary surface of the first part.

3. The tool of claim 2, wherein the primary surface of the first part lies opposite the secondary surface of the second part.

4. The tool of claim 1, wherein the first part and the second part are at least partially spatially separated from each other by a gap.

5. The tool of claim 1, wherein the second part has a coating that is different than the coating of the first part, wherein the coatings of the first and second parts are for manipulating the thermal radiation.

6. The tool of claim 1, wherein the first part is adjacent to the second part.

7. A method for selectively hot forming regions of a workpiece with the tool of claim 1, the method comprising:

disposing the workpiece in the tool;

performing at least one of a hot forming, tailored tempering, die forming, press forming, or punching operation on the work piece using at least one of the first part or the second part to work the workpiece, while simultaneously controlling the temperature of the workpiece as the workpiece is worked; and removing the workpiece from the tool.

8. The tool of claim 1, wherein the temperatures of the first and second parts are between about 450° C. to 550° C.

9. The tool of claim 1, wherein the device comprises a first layer and a second layer opposite the first layer; wherein the first layer is the white coating and the second layer is absorbent and tailored to the thermal radiation radiating from the first part.

10. The tool of claim 1, wherein an insulating layer is disposed between the first part and the second part.

11. The tool of claim 1, wherein the device further comprises a coating at least partially disposed on the second part, the coating being black such that the second part assumes the thermal radiation emission characteristics of a black body.

12. A tool for hot forming a workpiece, the tool comprising:

a first part that has a first temperature when the workpiece is heated and is configured to hold a temperature of the workpiece, or to cool a temperature of the heated workpiece to a temperature of the tool;

a second part having a second temperature that is warmer than the first temperature when the workpiece is heated; and a device for reducing thermal radiation at least between the first part and the second part, wherein the device for reducing the thermal radiation comprises a mirror that reflects thermal radiation from the second part, wherein the mirror is arranged in a gap formed between the first part and the second part;

wherein the first part and second part are configured to obtain a workpiece having different material properties.

13. The tool of claim 12, wherein the temperatures of the first and second parts are between about 450° C. to 550° C.

14. The tool of claim 12, wherein the mirror reflects infrared light.

15. The tool of claim 14, wherein the mirror comprises a highly reflective first side, and an absorbent second side, wherein the absorbent second side is tailored to the thermal radiation radiating from the first part.

16. The tool of claim 12, further comprising an insulating layer disposed between the first part and the second part.

17. A tool for hot forming a workpiece, comprising:

a first part having a first temperature that is different than a temperature of an environment in which the tool is used and being configured to hold a temperature of the workpiece, or to cool the temperature of the heated workpiece to the first temperature of the tool;

a second part having a second temperature that is warmer than the first temperature of the first part; and a device for manipulating thermal radiation, the device being disposed within a gap formed between the first and second parts, wherein said device is a thermal radiation absorbing coating having a first layer comprising an absorbent coating disposed on said first part and a second layer disposed atop the first layer that is at least partially white and configured to reflect thermal radiation from the second part;

wherein the first and second parts are configured to provide the workpiece with different material properties.

18. The tool of claim 17, wherein the device further comprises a coating at least partially disposed on the second part, the coating being black such that the second part assumes the thermal radiation emission characteristics of a black body.

19. The tool of claim 18, wherein a surface of the second part is roughened.

20. The tool of claim 19, wherein the temperatures of the first and second parts are between about 450° C. to 550° C.

* * * * *